US012429273B2

(12) United States Patent
Park et al.

(10) Patent No.: US 12,429,273 B2
(45) Date of Patent: Sep. 30, 2025

(54) REFRIGERATOR

(71) Applicant: LG Electronics Inc., Seoul (KR)

(72) Inventors: Dohyun Park, Seoul (KR); Haewon Seo, Seoul (KR); Sunghee Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 240 days.

(21) Appl. No.: 17/780,652

(22) PCT Filed: Sep. 1, 2021

(86) PCT No.: PCT/KR2021/011775
§ 371 (c)(1),
(2) Date: May 27, 2022

(87) PCT Pub. No.: WO2022/092536
PCT Pub. Date: May 5, 2022

(65) Prior Publication Data

US 2023/0213265 A1 Jul. 6, 2023

(30) Foreign Application Priority Data

Oct. 27, 2020 (KR) ..... 10-2020-0140076

(51) Int. Cl.
*F25D 17/04* (2006.01)
*F25D 23/02* (2006.01)
*F25D 29/00* (2006.01)

(52) U.S. Cl.
CPC ..... *F25D 17/045* (2013.01); *F25D 23/028* (2013.01); *F25D 29/005* (2013.01); *F25D 2317/063* (2013.01); *F25D 2317/0681* (2013.01)

(58) Field of Classification Search
CPC ..... F25D 17/045; F25D 2317/0681; F25D 2317/063; F25D 29/005; F25D 23/028
See application file for complete search history.

(56) References Cited

U.S. PATENT DOCUMENTS 4,920,765 A * 5/1990 McCauley ..... F25D 17/065 62/187
5,992,165 A * 11/1999 Kim ..... F25D 17/045 62/187
2018/0216866 A1* 8/2018 Xia ..... F25D 17/045

FOREIGN PATENT DOCUMENTS

CN 106895641 A * 6/2017 ..... F25D 17/06
CN 108120207 A * 6/2018 ..... F25D 11/02
(Continued)

OTHER PUBLICATIONS

Translated_Jeong (Year: 2004).*
(Continued)

*Primary Examiner* — Elizabeth J Martin
*Assistant Examiner* — Samba Nmn Gaye
(74) *Attorney, Agent, or Firm* — Fish & Richardson P.C.

(57) ABSTRACT

A refrigerator is proposed. The refrigerator includes a manipulation part including a rotating shaft and a manipulation knob, an opening/closing part configured to have a curved surface and located at a position adjacent to the circumference of the rotating shaft such that the opening/closing part opens and closes a communication portion between an inlet part and an enlarged part of a flow guide, and an angle limiting part configured to limit the rotation angle of the manipulation knob, whereby the manipulation knob of a thermostat for temperature control of the freezer compartment is configured to have the operation angle of 120~160°, thereby improving manipulation satisfaction during the manipulation of the manipulation knob by a user.

20 Claims, 16 Drawing Sheets

(56) References Cited

FOREIGN PATENT DOCUMENTS

| | | | | | |
|---|---|---|---|---|---|
| EP | 3367023 | A1 | | 8/2018 | |
| KR | 20000016666 | | | 9/2000 | |
| KR | 10-2003-0010825 | A | | 2/2003 | |
| KR | 200345579 | Y1 | * | 3/2004 | |
| KR | 10-0570534 | B1 | | 4/2006 | |
| KR | 100901033 | B1 | * | 6/2009 | |
| KR | 10-2016-0100548 | A | | 8/2016 | |
| KR | 2017006995 | A | * | 1/2017 | ..... F25D 17/06 |
| KR | 10-1736867 | B1 | | 5/2017 | |

OTHER PUBLICATIONS

Translated_Lei (Year: 2018).*
Translated_Hoon (Year: 2017).*
Translated_Lack (Year: 2009).*
Translated_Zhao (Year: 2017).*
Office Action in Australian Appln. No. 2021372198, mailed on Oct. 9, 2023, 4 pages.
International Preliminary Report on Patentability in International Appln. No. PCT/KR2021/011775, mailed on May 2, 2023, 5 pages.
Office Action in Vietnamese Appln. No. 10-2020-0140076, mailed on Jun. 25, 2024, 3 pages (with English translation).
Extended European Search Report in European Appln. No. 21886533.5, mailed on Aug. 27, 2024, 9 pages.

* cited by examiner

REFRIGERATOR

CROSS-REFERENCE TO RELATED APPLICATIONS

This application is a National Stage application under 35 U.S.C. § 371 of International Application No. PCT/KR2021/011775, filed on Sep. 1, 2021, which claims the benefit of Korean Patent Application No. 10-2020-0140076, filed on Oct. 27, 2020. The disclosures of the prior applications are incorporated by reference in their entirety.

BACKGROUND OF THE INVENTION

Field of the Invention

The present disclosure relates to a refrigerator in which a mechanical thermostat is provided such that a user can manually control the temperature of a storage compartment.

Description of the Related Art

Generally, a refrigerator is a household appliance which stores various foods or beverages for a long time with cold air produced by circulation of refrigerant according to a refrigeration cycle.

Such a refrigerator may be divided into a top freezer refrigerator having a freezer compartment disposed at the upper side of a refrigerating compartment; a bottom freezer refrigerator having a freezer compartment located at the lower side of a refrigerating compartment; and a side-by-side refrigerator having a refrigerating compartment and a freezer compartment located by being partitioned side by side.

As for the top freezer refrigerator, an evaporator is located in the rear space of the inside of the freezer compartment, and a grille fan assembly is provided in front of the evaporator, wherein a blower fan for the supply and circulation of cold air is mounted to the grille fan assembly.

A flow guide for a refrigerating compartment is formed in the grille fan assembly so as to guide the supply of a portion of cold air blown through the evaporator by the blower fan to the refrigerating compartment. The opened/closed degree of the flow guide for a refrigerating compartment is controlled by a thermostat and thus the temperature of the inside of the freezer compartment is controlled.

The thermostat mounted to the top freezer refrigerator is disclosed in Korean Utility Model Registration Publication No. 20-1991-0002814, Korean Patent Application Publication No. 10-2016-0100548, and Korean Patent Application Publication No. 10-2017-0006995.

The thermostat is configured such that a user manually rotates a manipulation knob in a side-to-side direction, which is exposed to the front surface of the grille fan assembly, such that an opening/closing plate provided at the manipulation knob controls the opened degree of a communication hole formed in the flow guide for a refrigerating compartment.

However, in the thermostat of the conventional top freezer refrigerator described above, the opening/closing plate is configured to block an associated flow path by being disposed perpendicularly to the flow direction of cold air flowing vertically along the flow guide for a refrigerating compartment. Accordingly, moisture such as a condensate present in the flow guide for a refrigerating compartment is accumulated and frozen on the upper surface of the opening/closing plate.

That is, due to the freezing of the moisture, the communication hole is partially or completely closed, or the opening/closing plate and a portion at which the communication hole are formed stick to each other such that the manipulation knob is not efficiently operated.

In addition, in the thermostat of the conventional top freezer refrigerator described above, the manipulation knob is configured to be manipulated by being tilted in the side-to-side direction, so it is difficult for a user to accurately perceive the manipulated degree of the manipulation knob.

For example, in the method of tilting the manipulation knob in the side-to-side direction, the manipulation knob is configured such that a user manipulates the manipulation knob only with one finger and thus the finger may slip, and in the case of the freezing of the manipulation knob, it is difficult to manipulate the manipulation knob and to perceive the manipulated degree thereof.

Of course, a number according to a manipulation level is printed on the circumferential surface of the manipulation knob so that a user can recognize the number. However, in such a structure, the size of the number is small, so it is difficult to check the number. In addition, to check the number, a finger is required to move from an associated portion, so during the manipulation of the manipulation knob, it is difficult to check a manipulated level, which makes the manipulation of the manipulation knob uncomfortable.

Furthermore, in the thermostat of the conventional top freezer refrigerator described above, the opening/closing plate is required to be integrated with the manipulation knob, and the flow guide is required to be provided with a counterpart having a communication hole formed therein, whereby additional work for the installation of the counterpart is required, which makes the manufacturability of the thermostat difficult.

In addition, due to the counterpart, the flow path of the inside of the flow guide unavoidably becomes narrow. Accordingly, to secure the flow path having a sufficient width, the flow guide is required to be increased in size correspondingly, so it is difficult to design the flow path for the formation of the flow path.

DOCUMENTS OF RELATED ART (Patent Document 1) Korean Utility Model Registration Publication No. 20-1991-0002814

(Patent Document 2) Korean Patent Application Publication No. 10-2016-0100548

(Patent Document 3) Korean Patent Application Publication No. 10-2017-0006995

SUMMARY OF THE INVENTION

Accordingly, the present disclosure has been made keeping in mind the above problems occurring in the related art, and the present disclosure is intended to propose a refrigerator in which the operation angle of a manipulation knob of a thermostat configured to control the temperature of a freezer compartment is further increased such that manipulation satisfaction can be improved during the manipulation of the manipulation knob by a user.

In addition, the present disclosure is intended to propose a refrigerator in which moisture flowing down through a flow guide is prevented from accumulating and freezing on the thermostat.

Furthermore, the present disclosure is intended to propose a refrigerator in which the reduction of a flow path due to a counterpart installed in the flow guide is prevented and the amount of flow discharged during the complete opening of the flow path is maximized such that the designing of the flow path for the formation of the flow path is easy.

In order to achieve the above objective, according to one aspect of the present disclosure, a refrigerator of the present disclosure may include a manipulation knob installed to be rotated clockwise or counterclockwise, and a gate configured to have a curved surface and to open and close a flow guide while rotating together with a rotating shaft of the manipulation knob.

In addition, in the refrigerator of the present disclosure, an angle limiter configured to limit an angle at which a manipulator is rotated may be included.

Furthermore, in the refrigerator of the present disclosure, the gate may be configured to have the radius of curvature smaller than the curved surface of an enlarged part.

Additionally, in the refrigerator of the present disclosure, the gate may be configured to have a length between opposite ends thereof which is longer than a width of a communication portion between an inlet part and the enlarged part.

In addition, in the refrigerator of the present disclosure, the gate may be configured to have the length between the opposite ends thereof which is short such that the gate does not form a shape of a semicircle by rectilinearly connecting the opposite ends to each other.

Furthermore, in the refrigerator of the present disclosure, the gate may be configured to be spaced apart from the inner surface of the flow guide.

Additionally, in the refrigerator of the present disclosure, when the gate is located to close the communication portion between the inlet part and the enlarged part, at least any one edge of the gate and at least any one edge of the communication portion may be configured to be spaced apart from each other.

In addition, the gate constituting the refrigerator of the present disclosure may be configured to be located at any one position of a first position at which the communication portion is completely opened, a second position at which a half of a first side of the communication portion is opened, a third position at which a portion of the first side of the communication portion is opened, a fourth position at which the communication portion is completely closed, and a fifth position at which a portion of a second side of the communication portion is opened.

Furthermore, in the refrigerator of the present disclosure, the opening ratio of the communication portion at the third position may be smaller than the opening ratio of the communication portion at the second position.

Additionally, in the refrigerator of the present disclosure, the opening ratio of the communication portion at the fifth position may be smaller than the opening ratio of the communication portion at the third position.

In addition, in the refrigerator of the present disclosure, the gate may have a communication hole formed therein.

Furthermore, in the refrigerator of the present disclosure, the communication hole of the gate may be configured to have a plurality of communication holes having sizes different from each other.

Additionally, in the refrigerator of the present disclosure, each of the communication holes may be configured to have a size increasing or decreasing gradually toward a second side of the gate from a first side thereof.

In addition, in the refrigerator of the present disclosure, an outlet part extending downward from the enlarged part to communicate with the refrigerating compartment may be formed.

Furthermore, in the refrigerator of the present disclosure, the lower end portion of the outlet part may be configured by being bent or curved such that the lower end portion protrudes forward, and a condensate drain hole may be formed in the lower surface of the inside of the outlet part.

Additionally, in the refrigerator of the present disclosure, the inlet part of the flow guide may be configured such that the entrance portion of the inlet part is located under the blower fan.

In addition, in the refrigerator of the present disclosure, the inlet part of the flow guide may have a flow path narrowing gradually toward the lower portion of the inlet part connected with the enlarged part.

Furthermore, in the refrigerator of the present disclosure, the angle limiter may limit the rotation of the gate up to an angle of 120 to 160° relative to the rotating shaft.

Additionally, in the refrigerator of the present disclosure, a connection part connecting the rotating shaft of the manipulator with the gate may be provided.

In addition, in the refrigerator of the present disclosure, the angle limiter may include a stopper configured to limit the rotation angle of the gate when completely opening or closing the gate.

In addition, in the refrigerator of the present disclosure, the manipulator may include a corrugated part having a plurality of ridges and furrows formed alternately on the manipulation knob along a rotating direction thereof, and in the enlarged part of the flow guide, a holding pin located at any one furrow of the corrugated part may be formed by protruding.

Furthermore, in the refrigerator of the present disclosure, each ridge of the corrugated part may be configured to be round, and the holding pin may be formed to be bendable.

As described above, according to the refrigerator of the present disclosure, the manipulation knob of the thermostat for temperature control of the freezer compartment may be configured to have an operation angle of 120~160°, thereby improving manipulation satisfaction during the manipulation of the manipulation knob by a user.

In addition, according to the refrigerator of the present disclosure, the gate may be configured to be spaced apart from the inner surface of the flow guide for a refrigerating compartment, thereby preventing moisture flowing down through the flow guide for a refrigerating compartment from accumulating and freezing on the thermostat.

Furthermore, according to the refrigerator of the present disclosure, the gate may be configured to close or open the flow guide for a refrigerating compartment, thereby making overall manufacturing simple, preventing freezing between counterparts due to the minimum number of components, and maximizing the amount of flow discharged during the complete opening of a flow path.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Hereinafter, an exemplary embodiment of the refrigerator of the present disclosure will be described with reference to FIGS. 1 to 16.

Figure 1:
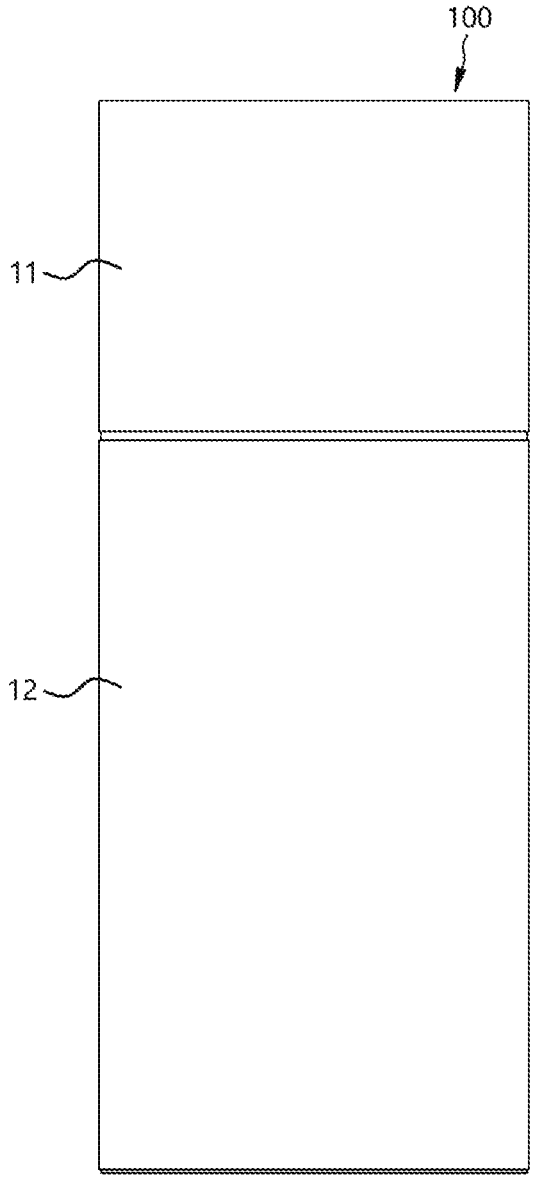
FIG. 1 is a front view illustrating a refrigerator according to an embodiment of the present disclosure.
Figure 2:
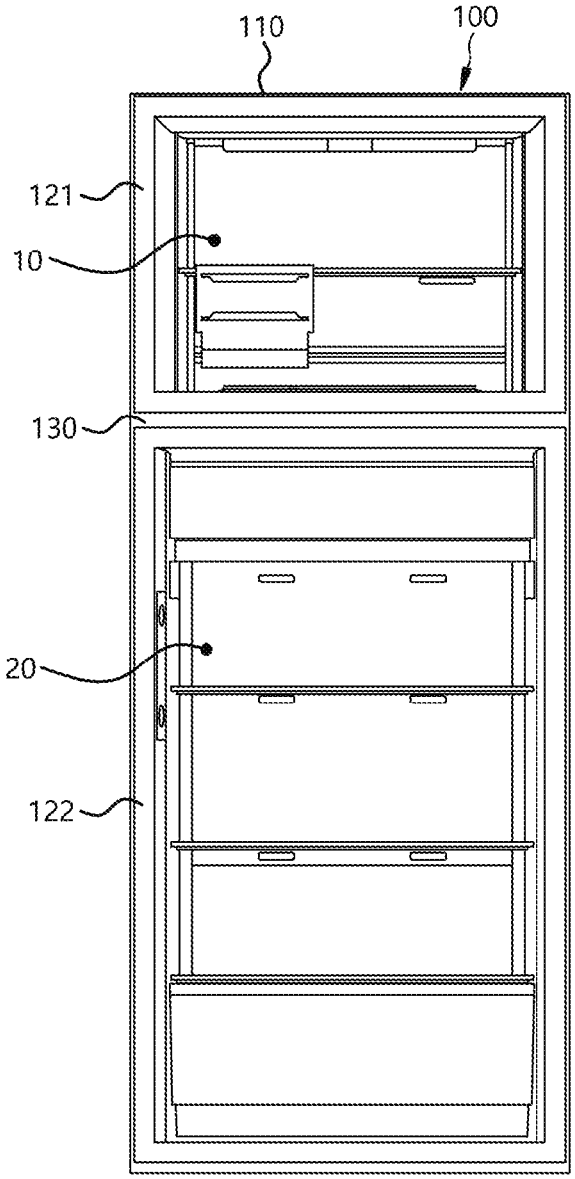
FIG. 2 is a front view illustrating a state in which a door is removed from the refrigerator to describe the inner state of the refrigerator according to the embodiment of the present disclosure.
Figure 3:
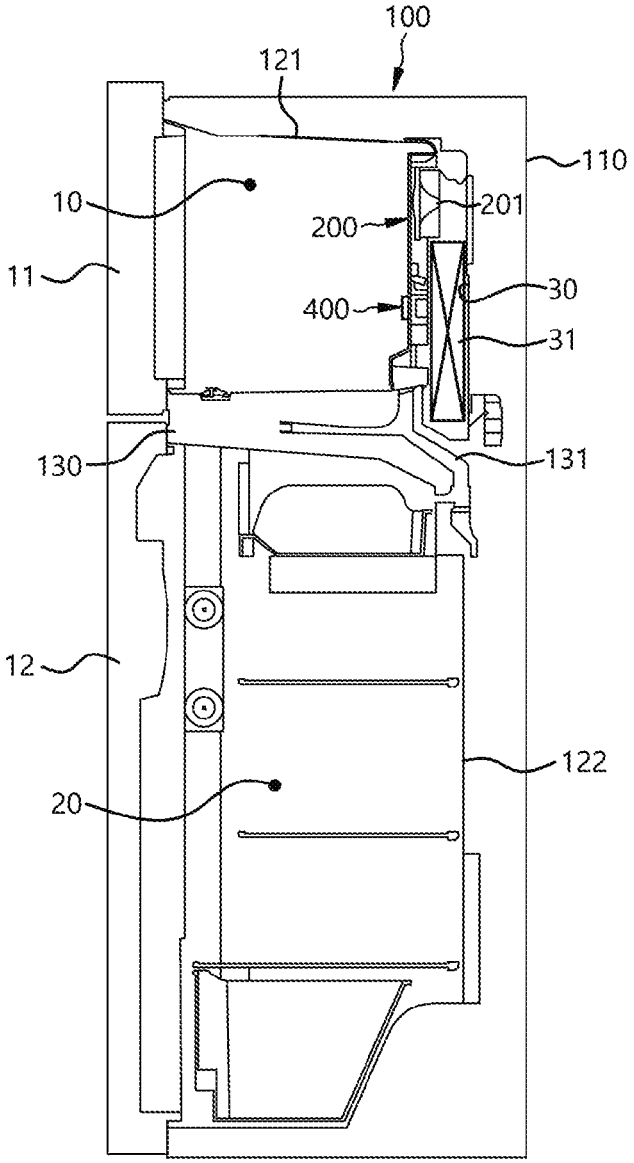
FIG. 3 is a sectional view illustrating the inside of the refrigerator according to the embodiment of the present disclosure.
Figure 4:
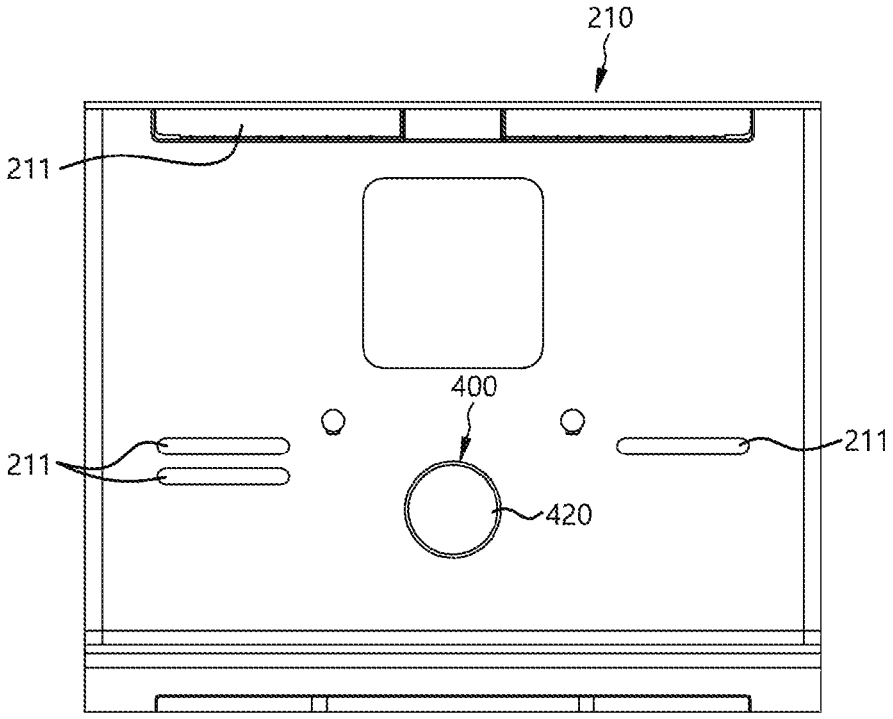
FIG. 4 is a front view of a grille fan constituting a grille fan assembly of the refrigerator according to the embodiment of the present disclosure.
Figure 5:
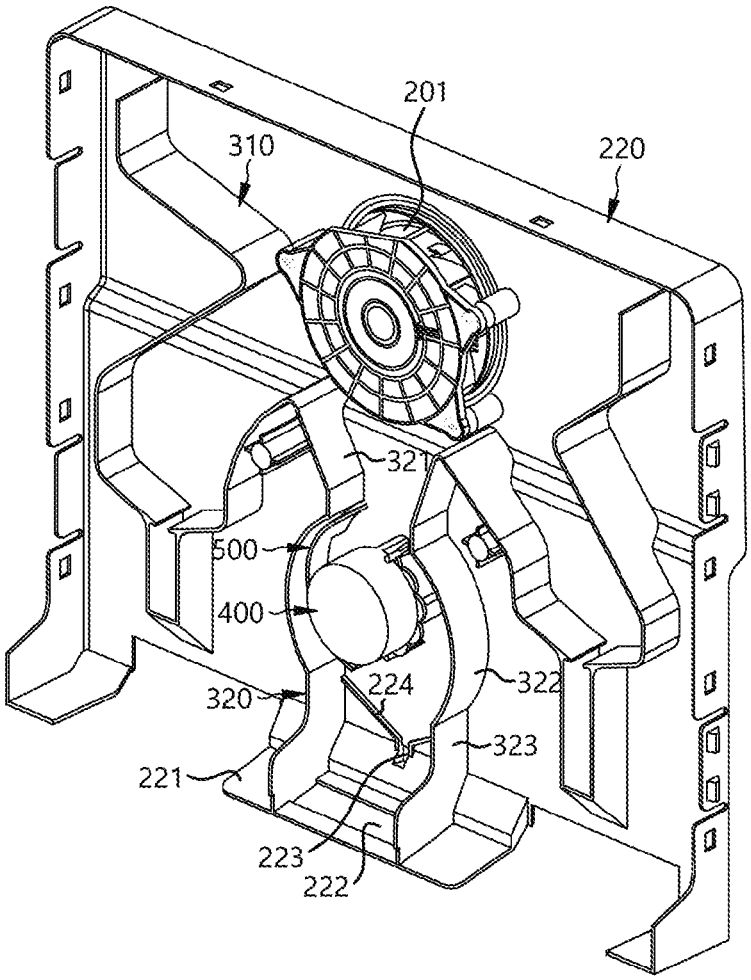
FIG. 5 is a perspective view of a shroud constituting the grille fan assembly of the refrigerator according to the embodiment of the present disclosure.
Figure 6:
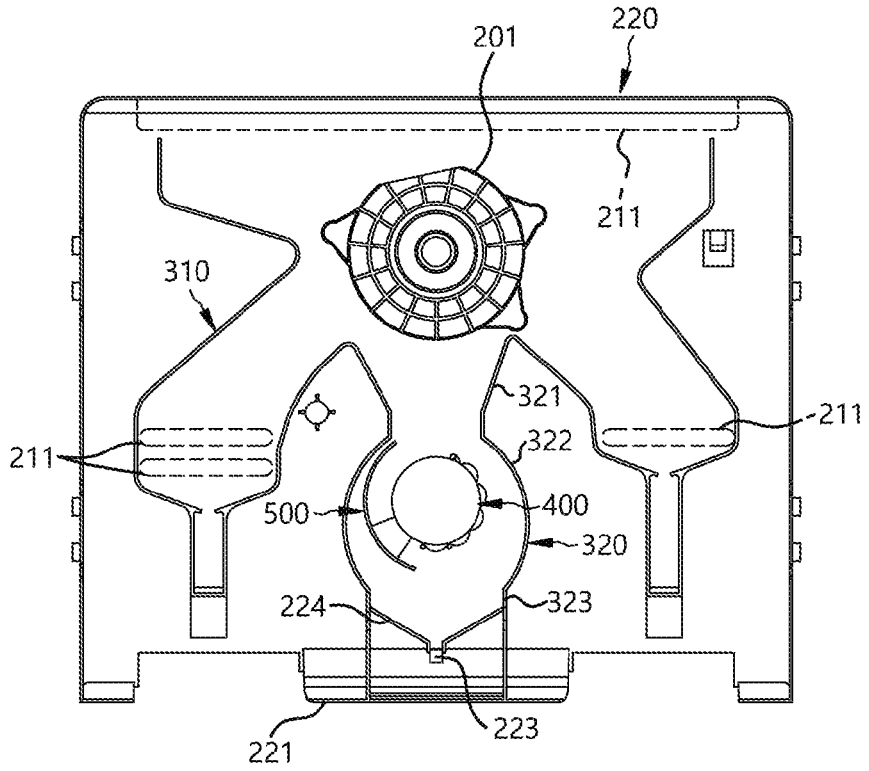
FIG. 6 is a front view of the shroud constituting the grille fan assembly of the refrigerator according to the embodiment of the present disclosure.

FIG. 1 is a front view illustrating a refrigerator according to the embodiment of the present disclosure; FIG. 2 is a front view illustrating a state in which a door is removed from the refrigerator to describe the inner state of the refrigerator according to the embodiment of the present disclosure; and FIG. 3 is a sectional view illustrating the inside of the refrigerator according to the embodiment of the present disclosure.

As illustrated these drawings, the refrigerator according to the embodiment of the present disclosure may include a body 100, a grille fan assembly 200, flow guides 310 and 320, a manipulator 400, a gate 500, and an angle limiter 600. Particularly, the manipulator 400 may be rotated up to an angle of 120° to 160° due to the angle limiter 600 to improve the feeling of manipulation.

Each of the components of the refrigerator according to the embodiment of the present disclosure will be described in more detail.

First, the refrigerator according to the embodiment of the present disclosure may include the body 100.

The body 100 may include an outer casing 110 constituting an exterior thereof, and inner casings 121 and 122 located inside the outer casing 110 and defining a storage space.

Here, the inner casings 121 and 122 may include the inner casing 121 for a freezer compartment constituting the freezer compartment 10 and the inner casing 122 for a refrigerating compartment constituting the refrigerating compartment 20.

In this case, a partition wall 130 may be located between the inner casing 121 for a freezer compartment and the inner casing 122 for a refrigerating compartment and may function to space the two inner casings 121 and 122 apart from each other.

In addition, the refrigerating compartment 20 may be located under the freezer compartment 10. That is, the partition wall 130 may be located at the lower side of the inner casing 121 for a freezer compartment, and the inner casing 122 for a refrigerating compartment may be located at the lower side of the partition wall 130.

Furthermore, the freezer compartment 10 and the refrigerating compartment 20 may be configured to be opened and closed by doors 11 and 21, respectively. In this case, each of the doors 11 and 21 may be configured as a swinging door, and although not shown, may be configured as a drawer type door.

Next, the refrigerator according to the embodiment of the present disclosure may include the grille fan assembly 200.

The grille fan assembly 200 may be located at a rear portion of the inside of the inner casing 121 for a freezer compartment, and the inside of the inner casing 121 for a freezer compartment may be divided into the freezer compartment 10 and an evaporation compartment 30 located at a front side and a rear side, respectively, relative to the grille fan assembly 200.

In addition, a blower fan 201 which blows cold air may be mounted to the grille fan assembly 200. In this case, the blower fan 201 may be configured as a module provided with a fan and a motor.

An evaporator 31 may be located at the evaporation compartment 30 and may generate cold air, and the blower fan 201 may supply cold air passing through the evaporator 31 to the freezer compartment 10 or to the refrigerating compartment 20.

Furthermore, the grille fan assembly 200 may include a grille fan 210 constituting a front surface thereof and a shroud 220 constituting a rear surface thereof.

A plurality of cold air outlets 211 may be formed in the grille fan 210 such that cold air is supplied into the freezer compartment 10, and the blower fan 201 may be mounted to the shroud 220.

Next, the refrigerator according to the embodiment of the present disclosure may include the flow guides 310 and 320.

The flow guides 310 and 320 may be formed by protruding from the front surface of the shroud 220 (or the rear surface of the grille fan) constituting the grille fan assembly 200, and may include a flow guide 310 for a freezer compartment configured to guide the flow of cold air to a portion at which each of the cold air outlets 211 of the grille fan 210 is formed, and a flow guide 320 for a refrigerating compartment configured to guide the flow of the cold air to the refrigerating compartment 20.

Particularly, the flow guide 320 for a refrigerating compartment may include an inlet part 321 receiving cold air blown by the blower fan 201, and an enlarged part 322 famed by extending and enlarging from the lower portion of the inlet part 321.

Here, the inlet part 321 may be configured to have an entrance portion located under the blower fan 201. That is, in cold air discharged in a radial direction due to the blower fan 201, cold air discharged toward the lower side of the blower fan 201 is intended to flow to the inlet part 321 of the flow guide 320 for a refrigerating compartment.

In this case, the entrance portion of the inlet part 321 is located directly under the blower fan 201. Of course, although not shown, the entrance portion of the inlet part 321 may be configured to be located at a lower portion of any one side of the blower fan 201.

In addition, the inlet part 321 of the flow guide 320 for a refrigerating compartment may be configured to have a flow path narrowing gradually toward the lower portion of the inlet part connected with the enlarged part 322. That is, through the structure of the inlet part 321, cold air blown by the blower fan 201 may be efficiently transferred to the refrigerating compartment 20.

Furthermore, the flow guide 320 for a refrigerating compartment may further include an outlet part 323 extending from the lower portion of the enlarged part 322 and communicating with the refrigerating compartment 20.

Additionally, a lower wall 221 of the shroud 220 may be configured at the lower end portion of the outlet part 323 such that the outlet part 323 is separated from the inner space of the freezer compartment 10. A cold air supply opening 222 for supplying cold air to the refrigerating compartment 20 may be formed at a front portion of the lower wall 221, and a condensate drain hole 223 may be formed at a rear side of the cold air supply opening 222 of the lower wall.

In addition, the lower end portion of the outlet part 323 may be configured by being bent or curved such that the lower end portion protrudes forward. Due to such a structure, cold air flowing along the outlet part 323 through the enlarged part 322 may be supplied to the refrigerating compartment 20 through the cold air supply opening 222.

Due to the condensate drain hole 223, moisture flowing together with the cold air in the flow guide 320 for a refrigerating compartment may not be supplied to the refrigerating compartment 20 but may be discharged to the outside of the grille fan assembly 200 (for example, a condensate collector located under the evaporator).

The cold air supply opening 222 may be located to correspond to a communication flow path 131 formed (or installed) through the partition wall 130, and cold air supplied to the communication flow path 131 through the cold air supply opening 222 may be supplied into the refrigerating compartment 20 by being guided by the communication flow path 131.

In addition, a guide jaw 224 may be formed on the inner wall surface of the shroud 220 and may be configured to guide the flow of a condensate from the entrance portion of the outlet part 323 to the condensate drain hole 223.

Meanwhile, the enlarged part 322 of the flow guide 320 for a refrigerating compartment may be configured as a structure having a curved surface formed by being enlarged gradually toward a center portion between the inlet part 321 and the outlet part 323 from portions communicating with the inlet part 321 and the outlet part 323, respectively.

The enlarged part 322 of the curved structure described above may allow the gate 500 to efficiently operate and may allow the flow resistance of cold air flowing through the enlarged part 322 to be minimized.

Next, the refrigerator according to the embodiment of the present disclosure may include a thermostat for controlling the temperature of the inside of the freezer compartment 10.

The thermostat may control the temperature of the inside of the freezer compartment 10 by controlling the opening ratio of the flow path of the flow guide 320 for a refrigerating compartment. That is, as the opening ratio of the flow path increases, the temperature of the inside of the freezer compartment 10 may increase, and as the opening ratio of the flow path decreases, the temperature of the inside of the freezer compartment 10 may decrease.

Such a thermostat may include the manipulator 400 for a manual manipulation by a user, the gate 500 for opening and closing the flow path of the flow guide 320 for a refrigerating compartment, and the angle limiter 600 configured to limit the operation angle of the gate 500.

Hereinafter, each of the components will be described in more detail with reference to FIGS. 5 to 16.

First, the manipulator 400 will be described.

Figure 8:
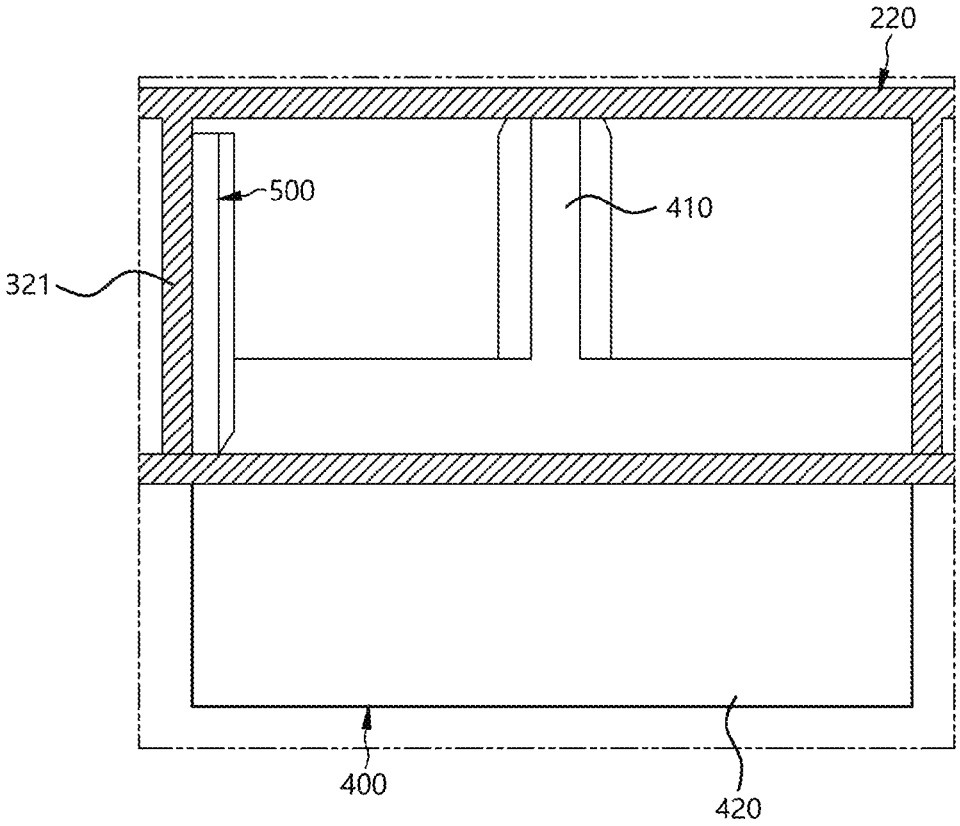
FIG. 8 is a top plan view of the state of FIG. 7.

As illustrated in FIG. 8, the manipulator 400 according to the embodiment of the present disclosure may include a rotating shaft 410 and a manipulation knob 420.

Here, the rotating shaft 410 may be installed to be rotatable in the enlarged part 322 of the flow guide 320 for a refrigerating compartment among portions of the shroud 220 which is the rear wall surface of the grille fan assembly 200.

In addition, the manipulation knob 420 may be configured to be integrated with the rotating shaft 410 and may be installed such that the manipulation knob 420 can be manipulated to be rotated clockwise or counterclockwise relative to the rotating shaft 410.

In addition, at least a portion of the manipulation knob 420 may be located to be exposed to the front side of the grille fan 210 by passing through the grille fan 210 which is the front surface of the grille fan assembly 200.

That is, a manipulation knob used in the thermostat according to a conventional technology has a shaft directed vertically and is configured to control the opening ratio of the flow path by being tilted in a side-to-side direction, whereas the manipulation knob 420 of the thermostat according to the embodiment of the present disclosure has a shaft directed in a front-to-rear direction and is configured to control the opening ratio of the flow path by being rotated clockwise or counterclockwise such that a user can more accurately perceive the manipulated degree of the manipulation knob 420 and can easily control the manipulated amount thereof.

Furthermore, according to the embodiment of the present disclosure, the manipulation knob 420 may be configured to be rotated up to an angle of 120 to 160° due to the angle limiter 600 to be described later. Accordingly, the manipulation knob 420 may be configured to be rotated at at least four levels even if the manipulation levels of the manipulation knob 420 are designed at 30° intervals, so a user may easily and accurately manipulate the manipulation knob 420 and may more precisely perform temperature control.

Next, the gate 500 will be described.

The gate 500 may be located at a position adjacent to the circumference of the rotating shaft 410 and may be configured to open and close a communication portion between the inlet part 321 and the enlarged part 322 of the flow guide 320 for a refrigerating compartment while the gate 500 rotates with the rotating shaft 410.

Such a gate 500 and the rotating shaft 410 may be configured to be spaced apart from each other and may be connected with each other by the connection part 510 to operate in cooperation with each other. The gate 500 may have a curved surface and may be configured as a plate covering a portion of the circumference of the rotating shaft 410.

In addition, the gate 500 may be configured to open and close the communication portion open between the inlet part 321 and the enlarged part 322 of the flow guide 320 for a refrigerating compartment.

The gate 500 may be configured to have a length between opposite ends thereof which is longer than the open width of the communication portion between the inlet part 321 and the enlarged part 322 and is short such that the gate 500 does not form a shape of a semicircle by rectilinearly connecting the opposite ends to each other.

That is, when the manipulation knob 420 is rotated from 0° up to 120° to 160°, the gate 500 may be configured to have a size in which the gate 500 completely opens or closes the communication portion between the inlet part 321 and the enlarged part 322.

In addition, the gate 500 may be configured to be located at any one position of a first position (see FIGS. 7 and 8) at which the communication portion is completely opened, a second position (see FIGS. 9 and 10) at which a first end of the gate 500 is located at the center portion of the communication portion, a third position (see FIGS. 11 and 12) at which the first end of the gate 500 is adjacent to a first end of the communication portion and the communication portion is partially opened, a fourth position (see FIGS. 13 and 14) at which the center portion of the gate 500 is located at the center portion of the communication portion, and a fifth position (see FIGS. 15 and 16) at which a second end of the gate 500 is adjacent to a second end of the communication portion and the communication portion is partially opened.

In this case, the opening ratio of the communication portion at the third position may be smaller than the opening ratio of the communication portion at the second position, and the opening ratio of the communication portion at the fifth position may be smaller than the opening ratio of the communication portion at the third position.

To this end, communication holes 521 and 522 (see FIGS. 12 and 14) may be formed in the gate 500.

That is, according to the position of the gate 500, the entirety of the communication holes 521 and 522 may be located at the communication portion or a portion of the communication holes 521 and 522 may be located at the communication portion such that the communication holes 521 and 522 have opening ratios different from each other.

Particularly, the communication holes 521 and 522 of the gate 500 may be configured to have a plurality of communication holes. In this case, the communication holes 521 and 522 may be formed to have sizes different from each other.

Specifically, each of the communication holes 521 and 522 may be configured to have a size increasing or decreasing gradually toward a second side of the gate 500 from a first side thereof.

In the embodiment of the present disclosure, each of the communication holes 521 and 522 may be configured to have a size decreasing gradually toward the second side of the gate 500 from the first side thereof. That is, the opening ratio of the communication portion may decrease gradually toward the second side of the gate 500 from the first side thereof.

In addition, the gate 500 may be configured to have a radius of curvature smaller than a radius of curvature of a curved surface constituting the enlarged part 322. Such a structure is intended to enable the gate 500 to accurately operate without interfering with the enlarged part 322 inside the enlarged part 322.

Additionally, the gate 500 is preferably configured to be spaced apart from the inner surface of the flow guide 320 for a refrigerating compartment.

In addition, at the fourth position, the gate 500 may be configured such that the opposite portions of the gate 500 are spaced apart from the opposite edges of the communication portion, respectively, to have distances G apart therefrom.

The distance G between the gate 500 and the inner surface of the flow guide 320 for a refrigerating compartment is intended for water to be drained. That is, when the gate 500 and the inner surface of the flow guide 320 for a refrigerating compartment are configured to be in contact with each other, moisture contained in cold air may be accumulated and frozen at the contact portion, which may cause the malfunction of the thermostat. However, due to the distance G, the freezing of moisture may be prevented.

A distance G between the gate 500 and the inner surface of the flow guide 320 for a refrigerating compartment is preferably in the range of about 1.5~3 mm. That is, the distance G is the shortest distance or more (for example, 1.5 mm or more) to drain water and is 3 mm or less to prevent increase in the amount of leakage of cold air due to excessive distance (greater than 3 mm) between the gate 500 and the inner surface of the flow guide 320.

Next, the angle limiter 600 will be described.

The angle limiter 600 may be configured to limit the rotation of the manipulation knob 420 such that the manipulation knob 420 can be rotated only up to an angle of 120° or more and 160° or less relative to the rotating shaft 410.

The limitation of the rotation angle of the manipulation knob 420 is intended to facilitate manipulation of the manipulation knob 420 and improve a user's usability.

That is, in a case in which the manipulation knob 420 is configured to be rotated only at an angle less than 120°, when the manipulation knob 420 is designed to have the manipulation angles of at least four levels 4, the manipulation angle of each of the four levels may be required to be set to be less than 30°, so the feeling of manipulation may unavoidably deteriorate. In a case in which the manipulation knob 420 is configured to be rotated at an angle greater than 160°, when a user intends to completely rotate the manipulation knob 420 by manipulating the manipulation knob 420 once, the user's wrist may be twisted, so the inconvenience of having to manipulate the manipulation knob 420 twice may be caused.

In consideration of this, the manipulation knob 420 is most preferably configured to operate up to an angle of 120° or more and 160° or less.

Such an angle limiter 600 may include a stopper 610 and a holding jaw 620.

That is, while the rotating shaft 410 rotates in a first direction or a second direction, the holding jaw 620 may hit the stopper 610 to limit the rotation of the manipulation knob 420.

The stopper 610 may be formed at the front surface of the shroud 220 by protruding therefrom, and the holding jaw 620 may be formed at any one portion of the manipulator 400 or any one portion of the gate 500. Although not shown, the stopper 610 may be formed at the manipulator 400 or the gate 500, and the holding jaw 620 may be formed at the front surface of the shroud 220.

The holding jaw 620 may be formed on the circumferential surface of the manipulation knob 420 by protruding therefrom such that the holding jaw 620 can limit the rotation of the manipulation knob 420 by hitting the stopper 610 during the maximum opening manipulation of the flow path.

A structure such as the holding jaw 620 which limits the rotation of the manipulation knob 420 by hitting the stopper 610 during the maximum closing manipulation of the flow path may be formed on the circumferential surface of the manipulation knob 420. In addition, in the embodiment of the present disclosure, the connection part 510 connecting the rotating shaft 410 with the gate 500 may also function to limit the rotation of the manipulation knob 420 by hitting the stopper 610 during the maximum closing manipulation of the flow path.

Meanwhile, a corrugated part 421 having a plurality of ridges 421*a* and furrows 421*b* formed alternately along the rotating direction of the manipulation knob 420 may be formed on the circumferential surface of the manipulation knob 420 constituting the manipulator 400, and in the enlarged part 322 of the flow guide 320 for a refrigerating compartment, a holding pin 422 located at any one furrow 421*b* of the corrugated part 421 may be formed by protruding.

The corrugated part 421 and the holding pin 422 may be structures assisting a user such that the user can perceive the manipulation angle of the manipulation knob 420.

That is, the corrugated part 421 and the holding pin 422 enable a user to perceive tactilely and audibly that the holding pin 422 is located at a furrow 421*b* after passing any one ridge 421*a* of the corrugated part 421 such that the user can easily perceive the manipulation angle even if the manipulation of the manipulation knob 420 in the freezer compartment 10 is not easily seen.

Each of the furrows 421*b* of the corrugated part 421 is preferably formed at every angle of approximately 30 to 35°. That is, when the manipulation knob 420 may be configured to be rotated up to an angle of 120° or more and 160° or less by considering that in the case of a structure that a user rotates the manipulation knob 420 by gripping the manipulation knob 420 as in the embodiment of the present disclosure, the angle of rotation at which the user can easily control the rotation of the manipulation knob 420 is approximately 30°, only four to six level manipulations may be performed, so more fine and easy manipulation may be performed.

Of course, each of the furrows 421*b* of the corrugated part 421 may be configured to have an interval therebetween smaller or larger than 30~35°. However, when the interval between each of the furrows 421*b* is smaller than 30° or larger than 35°, manipulatory inconvenience for each level rotation may be caused.

In the embodiment of the present disclosure, the furrow 421*b* includes five furrows formed at intervals of 32°. That is, due to the structure, a user may control the opening ratio of the flow path at five levels of the intervals of 32°, so manipulation satisfaction may be improved. In this case, the manipulation knob 420 may be designed to have the maximum operation angle of 128°.

Particularly, each of the ridges 421*a* the corrugated part 421 may be configured to be round, and the holding pin 422 may be formed to be bendable. Accordingly, in a process in which the holding pin 422 moves over each of the ridges 421*a* during the rotation of the manipulation knob 420, resistance which the holding pin 422 provides to a user may be reduced as much as possible, and when the holding pin 422 is located at each of the furrows 421*b*, a hitting sound is generated, so audible perception is possible at every level.

Of course, the manipulation knob 420 may be configured to be operated at an angle smaller than 120° or at an angle larger than 160°. In this case, an interval between each of the furrows 421*b* of the corrugated part 421 may be smaller or larger than 30~35°.

Hereinafter, a process in which the temperature of the freezer compartment 10 of the refrigerator according to the embodiment of the present disclosure is controlled will be described.

First, in the refrigerator, a compressor (not shown) constituting a refrigeration cycle and the blower fan 201 may operate according to the temperature condition of the inside of the refrigerating compartment 20.

That is, when temperature in the refrigeration compartment 20 reaches a dissatisfactory range (a temperature range higher than a set temperature), the compressor may operate and a refrigerant may flow sequentially through a condenser, an expansion mechanism, and the evaporator 31. At the same time, as the blower fan 201 is operated, heat-exchanged cold air passing through the evaporator 31 may be supplied to the freezer compartment 10 and the refrigeration compartment 20 through the grille fan assembly 200.

In this case, cold air recovered from the freezer compartment 10 or the refrigeration compartment 20 by the operation of the blower fan 201 may pass through the evaporator 31. In this process, moisture of the cold air passing through the evaporator 31 may be removed, and the cold air may be heat-exchanged to a lower temperature.

In addition, the cold air passing through the evaporator 31 may pass through the blower fan 201 and then may flow into the grille fan assembly 200.

Continuously, the cold air introduced into the grille fan assembly 200 may be supplied to the freezer compartment 10 and the refrigerating compartment 20 by being guided by the flow guide 310 for a freezer compartment and the flow guide 320 for a refrigerating compartment, respectively, formed in the grille fan assembly 200.

In this case, the cold air flown by the guidance of the flow guide 310 for a freezer compartment may be supplied into the freezer compartment 10 through the cold air outlet 211 formed in the grille fan 210, and the cold air flown by the guidance of the flow guide 320 for a refrigerating compartment may be supplied to the refrigerating compartment with cold air supply control performed by the thermostat.

Meanwhile, the thermostat may be manually manipulated by a user, and due to such manipulation of a user, the flow guide 320 for a refrigerating compartment may be closed such that the temperature of the freezer compartment 10 is further decreased, or the flow guide 320 for a refrigerating compartment may be opened such that the temperature of the freezer compartment 10 is further increased.

That is, the gate 500 may be located at any one position of the first position, the second position, the third position, the fourth position, and the fifth position by the manipulation of the manipulation knob 420 by a user such that the amount of cold air passing through the flow guide 320 for a refrigerating compartment is controlled.

Figure 7:
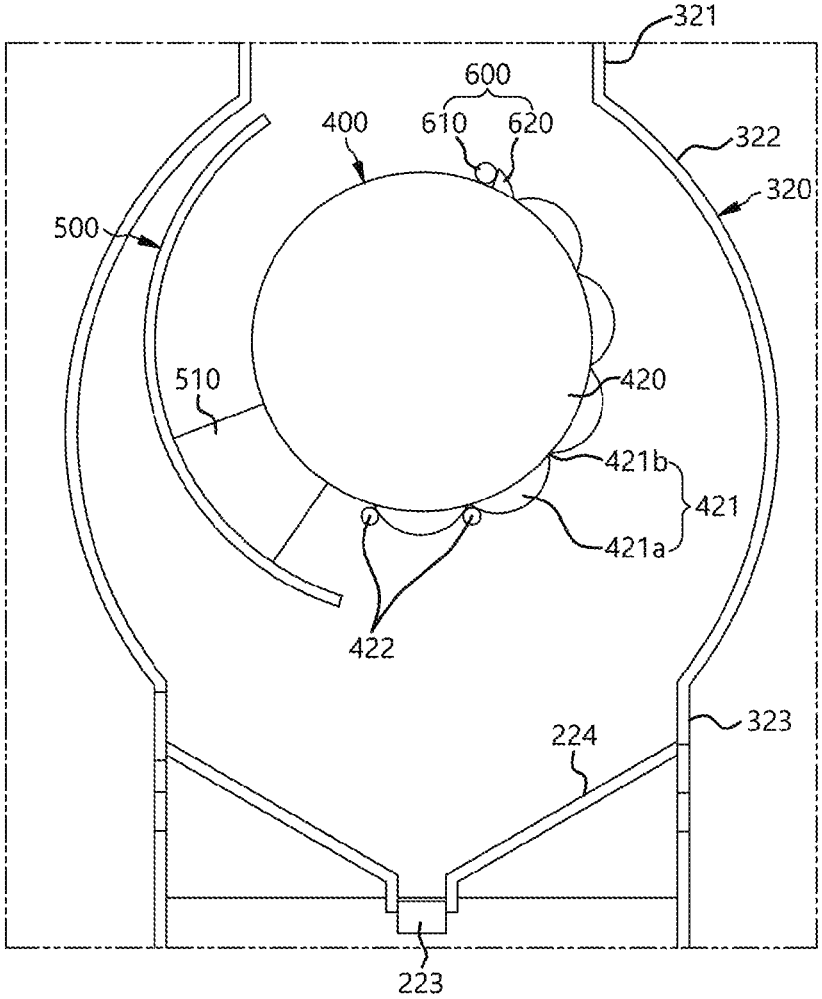
FIG. 7 is an enlarged view illustrating a state in which a gate of the refrigerator according to the embodiment of the present disclosure is located at a first position.

For example, when a user completely rotates the manipulation knob 420 counterclockwise, the gate 500 may be located at the first position and may completely open the communication portion between the inlet part 321 and the enlarged part 322 constituting the flow guide 320 for a refrigerating compartment. This is illustrated in FIG. 7.

When the gate 500 is located at the first position, the stopper 610 constituting the angle limiter 600 may be in contact with the holding jaw 620 formed on the circumferential surface of the manipulation knob 420, and accordingly, the manipulation knob 420 may not be rotated counterclockwise any longer.

Figure 9:
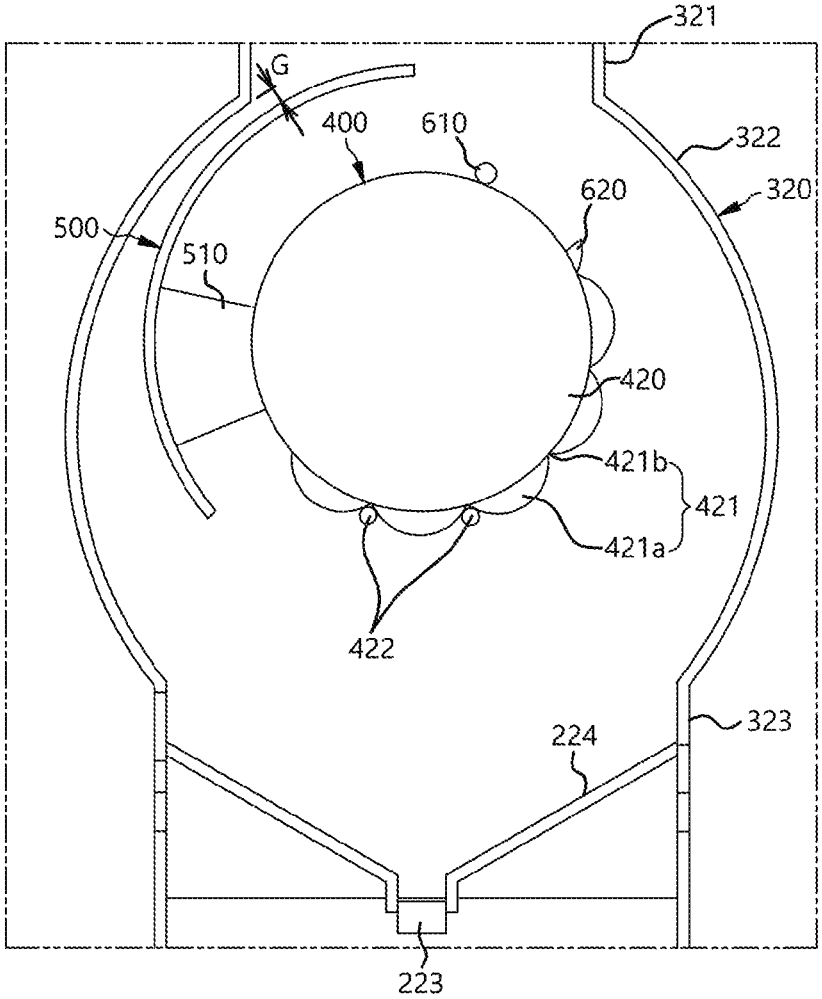
FIG. 9 is an enlarged view illustrating a state in which the gate of the refrigerator according to the embodiment of the present disclosure is located at a second position.
Figure 10:
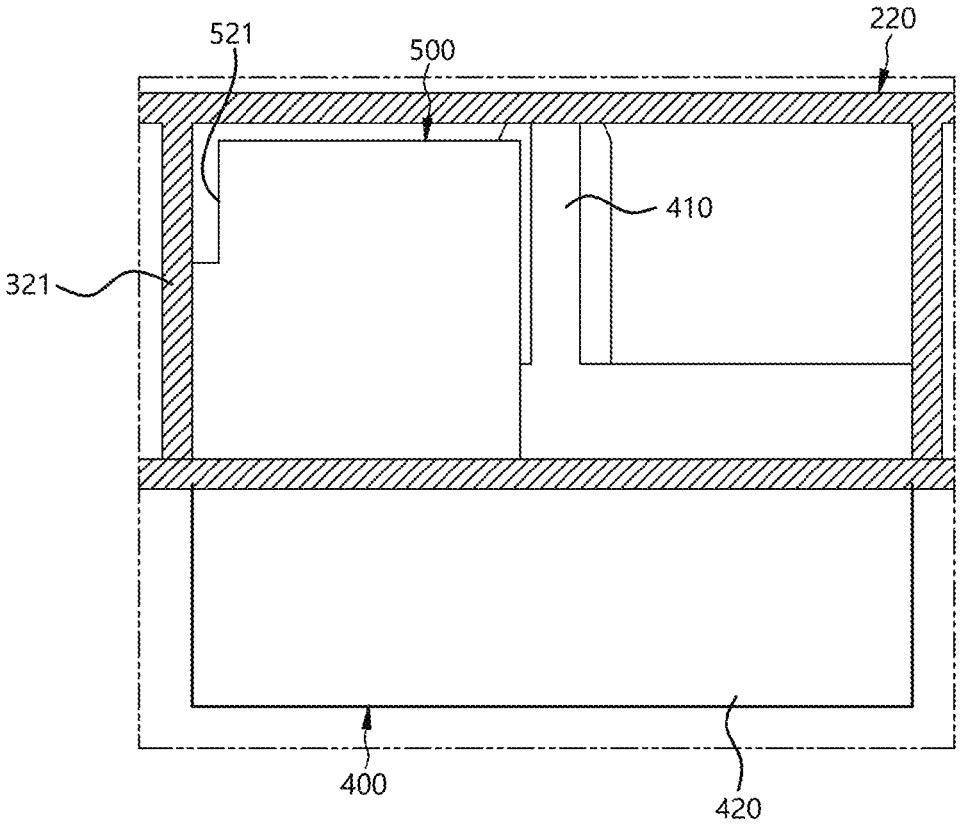
FIG. 10 is a top plan view of the state of FIG. 9.
Figure 11:
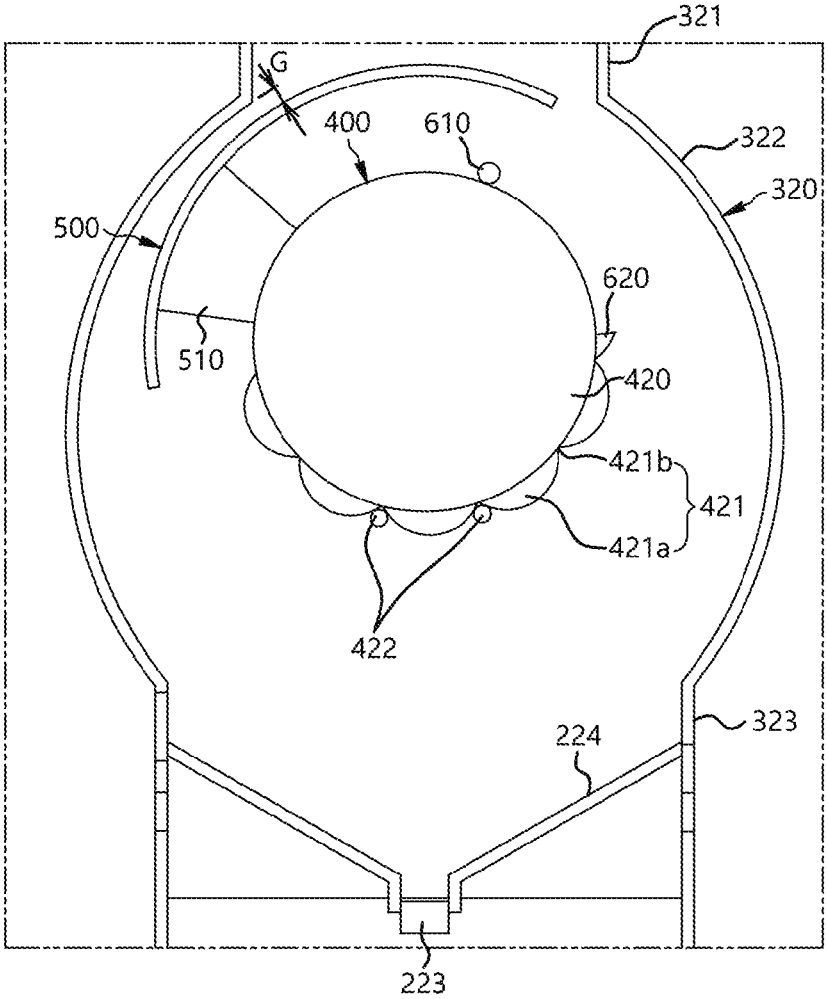
FIG. 11 is an enlarged view illustrating a state in which the gate of the refrigerator according to the embodiment of the present disclosure is located at a third position.
Figure 12:
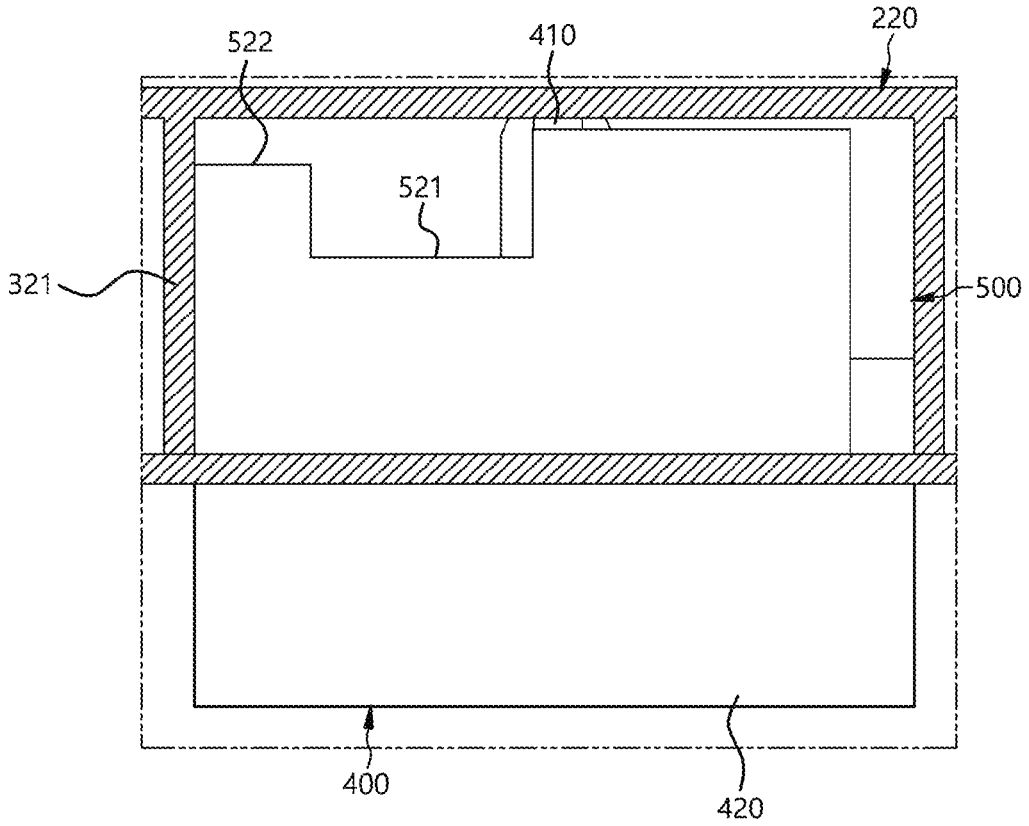
FIG. 12 is a top plan view of the state of FIG. 11.
Figure 13:
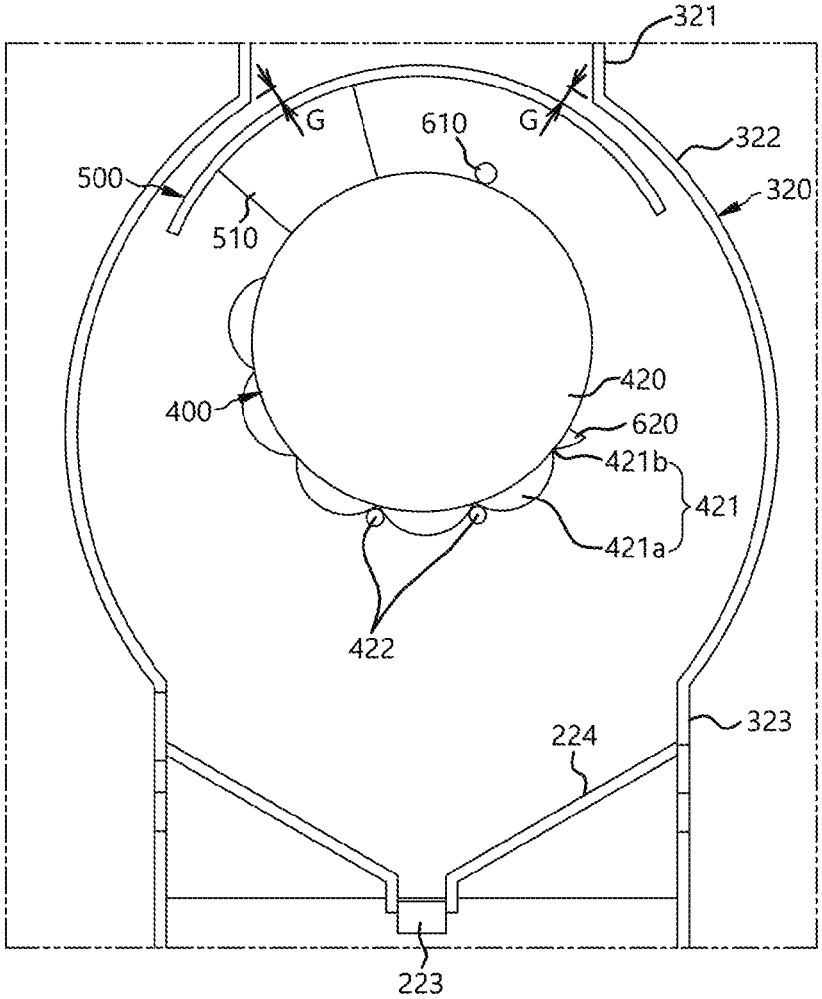
FIG. 13 is an enlarged view illustrating a state in which the gate of the refrigerator according to the embodiment of the present disclosure is located at a fourth position.
Figure 14:
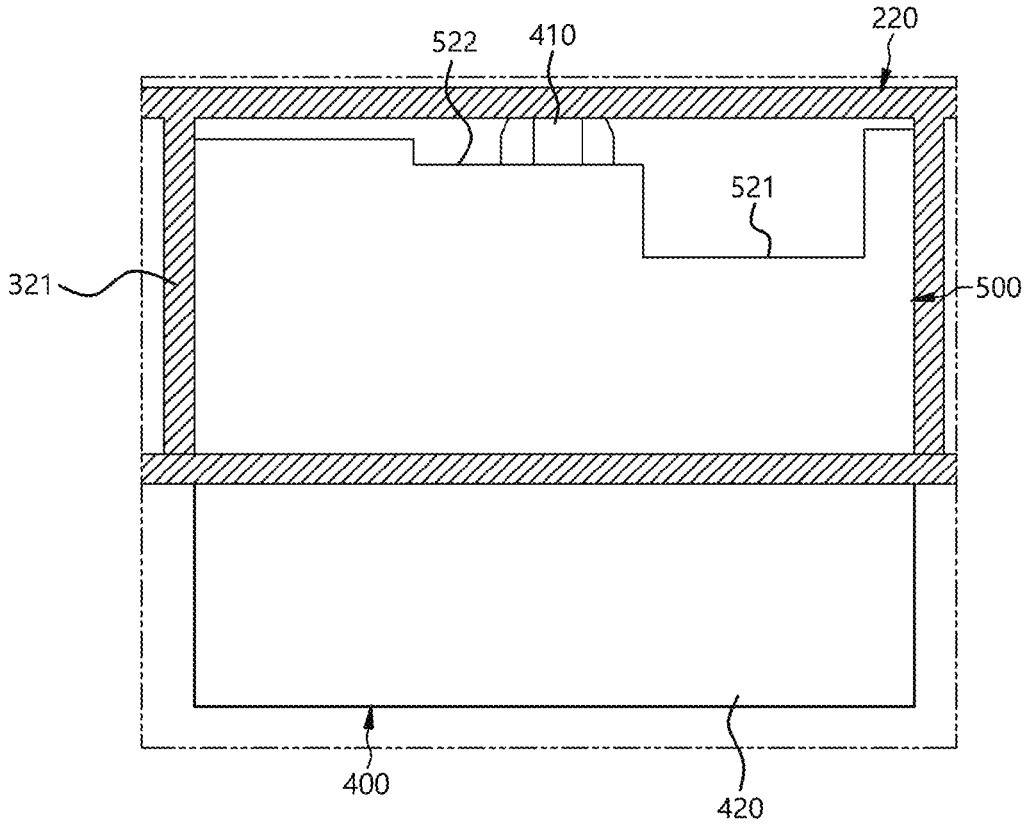
FIG. 14 is a top plan view of the state of FIG. 13.
Figure 15:
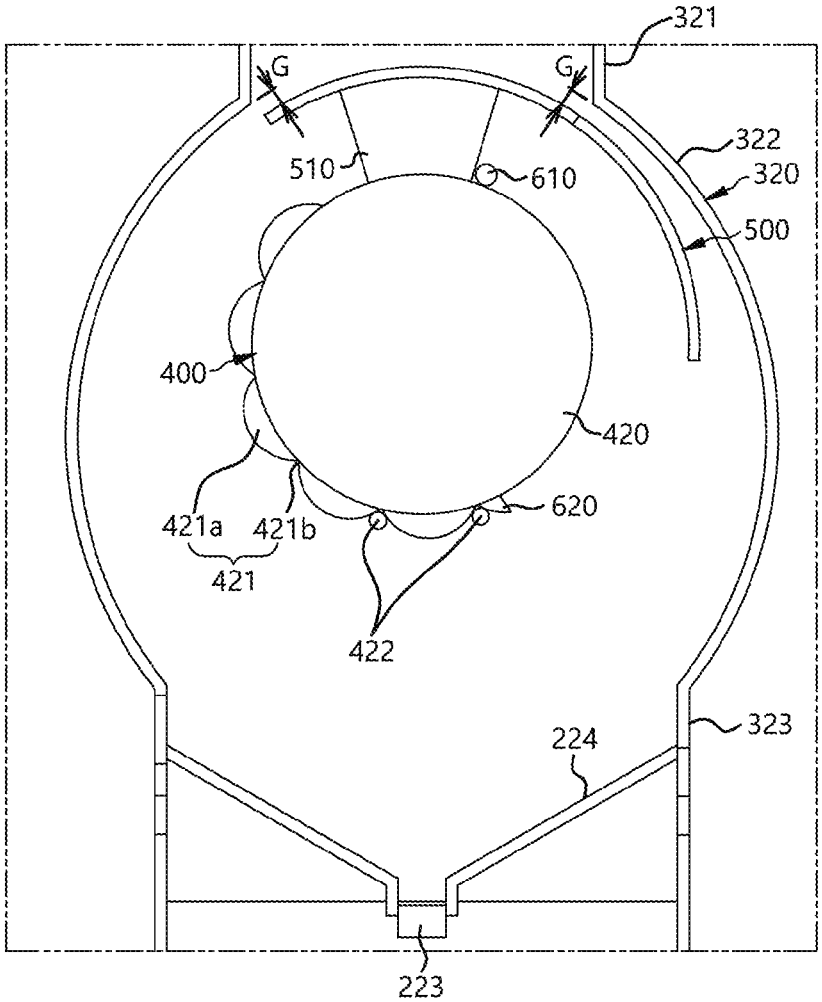
FIG. 15 is an enlarged view illustrating a state in which the gate of the refrigerator according to the embodiment of the present disclosure is located at a fifth position.
Figure 16:
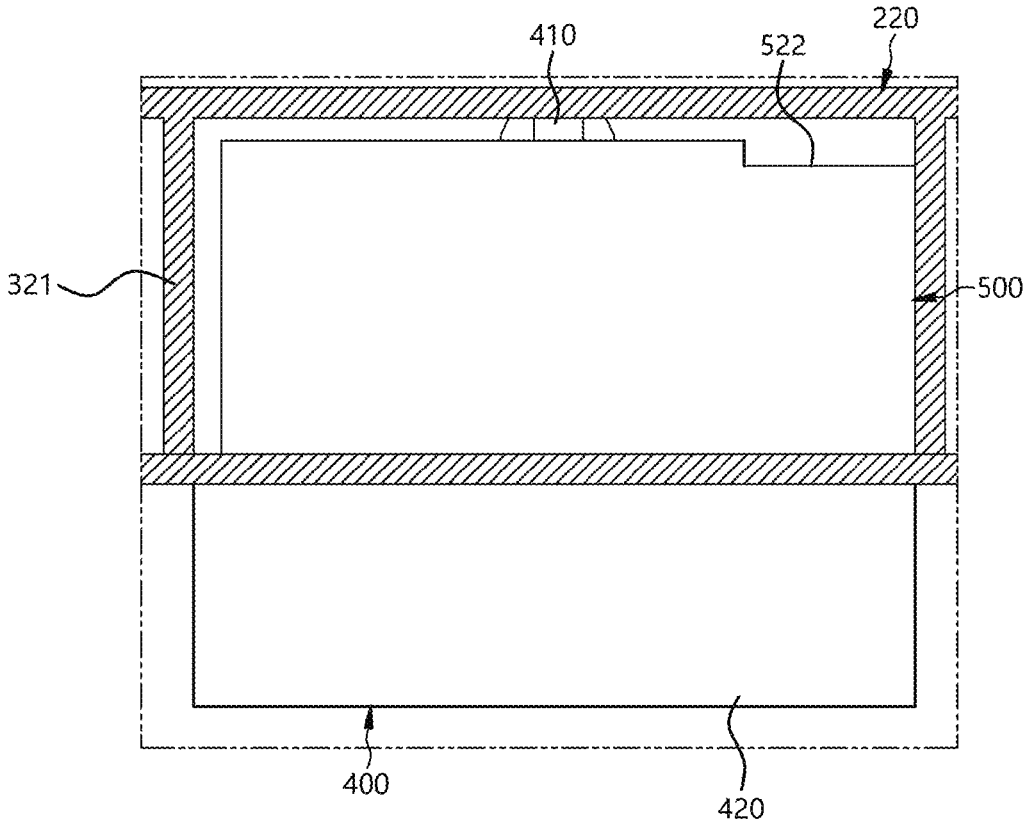
FIG. 16 is a top plan view of the state of FIG. 15.

In addition, in the state in which the gate 500 is located at the first position, when a user performs a first level rotation of the manipulation knob 420 clockwise, the gate 500 may be located at the second position and may open only a half of the communication portion. In this case, the first level rotation may mean that in a state in which the holding pin 422 is located at any one of the furrows 421*b* constituting the corrugated part 421, the holding pin 422 is located at another furrow 421*b* located at a side of the furrow 421*b* due to the rotation of the manipulation knob 420. This is illustrated in FIG. 9.

In the state in which the gate 500 is located at the first position, when a user performs a second level rotation of the manipulation knob 420 clockwise (or a first level rotation in a state in which the gate 500 is located at the second position), the gate 500 may be located at the third position and may open only a portion of the communication portion. In this case, in each of the communication holes 521 and 522 formed in the gate 500, the communication hole 521 having a relatively larger size may be in a state corresponding to the communication portion such that the gate 500 at the third position has an opening ratio smaller than the opening ratio of the gate 500 at the second position.

In a state in which the gate 500 is located at the first position, when a user rotates a third level rotation of the manipulation knob 420 clockwise (or the first level rotation in a state in which the gate 500 is located at the third position), the gate 500 may be located at the fourth position and may completely block the communication portion. In this case, each of the communication holes 521 and 522 formed in the gate 500 may be in a state corresponding to the communication portion such that the gate 500 at the fourth position has an opening ratio smaller than the opening ratio of the gate 500 at the third position.

In a state in which the gate 500 is located at the first position, when a user performs a fourth level rotation of the manipulation knob 420 clockwise (or the second level rotation in the state in which the gate 500 is located at the third position), the gate 500 may be located at the fifth position and may open only a portion of the communication portion. In this case, in each of the communication holes 521 and 522 formed in the gate 500, the communication hole 522 having a relatively smaller size may be in a state corresponding to the communication portion such that the gate 500 at the fifth position has an opening ratio smaller than the opening ratio at the fourth position.

In the manipulation of the manipulation knob 420 described above, an interval between each level may be the angle of 32°, so each level manipulation may be easily performed. In addition, the level manipulation may be accurately performed due to the structure of the corrugated part 421 and the holding pin 422.

Particularly, since the manipulation angle of the manipulation knob 420 does not exceed 160° from the initial position of the manipulation knob 420, a user can manipulate each level manipulation of the manipulation knob 420 by a one-time rotation manipulation of the manipulation knob 420 without the user's arm being twisted.

In addition, in a state in which the gate 500 is located at the fifth position, the stopper 610 constituting the angle limiter 600 may be in contact with a side surface of the connection part 510, and thus the manipulation knob 420 may not be rotated clockwise any longer.

Furthermore, cold air supplied to the refrigerating compartment 20 along the flow guide 320 for a refrigerating compartment may contain moisture, and in a state in which the gate 500 is located at any one position of the second position to the fourth position, the moisture may be frozen between the gate 500 and the inner surface of the enlarged part 322.

However, the gate 500 may be configured to be spaced apart by the distance G of 1.5~3 mm from the inner surface of the enlarged part 322, whereby even if the gate 500 is located to block the communication portion between the inlet part 321 and the enlarged part 322, moisture may be discharged through a gap defined due to the distance G, which may prevent the freezing of the moisture.

In this case, the moisture introduced into the enlarged part 322 through the gap having the distance G may flow along the guide jaw 224 located inside the outlet part 323 extending from the lower portion of the enlarged part 322, may be discharged to the outside of the grille fan assembly 200 through the condensate drain hole 223, and then may be accumulated in the condensate collector (not shown) located under the evaporator 31 and be discharged.

When the temperature of the inside of the refrigeration compartment 20 reaches a satisfactory range (a set temperature is satisfied) during the supply of cold air to the refrigerating compartment 20 through the flow guide 320 for a refrigerating compartment described above, the operation of the blower fan 201 and the compressor may stop.

At last, in the refrigerator of the present disclosure, the manipulation knob 420 of the thermostat for temperature control of the freezer compartment 10 may be configured to have the operation angle of 120~160°, thereby enabling temperature to be easily controlled without any manipulatory inconvenience when the manipulation knob 420 is manually manipulated by a user.

Furthermore, in the refrigerator of the present disclosure, the gate 500 may be configured to be spaced apart from the inner surface of the flow guide 320 for a refrigerating compartment, thereby preventing moisture flowing down through the flow guide 320 for a refrigerating compartment from accumulating and freezing on the thermostat.

Additionally, in the refrigerator of the present disclosure, the gate 500 may be configured to close or open the flow guide 320 for a refrigerating compartment, thereby making overall manufacturing simple, preventing freezing between counterparts due to the minimum number of components, and maximizing the amount of flow discharged during the complete opening of a flow path.

What is claimed is:

1. A refrigerator comprising:

a body having a freezer compartment and a refrigerating compartment located below the freezer compartment;

a grille fan assembly located at a rear side of the freezer compartment, the grille fan assembly comprising a blower fan configured to blow cold air;

a flow guide disposed in the grille fan assembly and configured to guide the cold air toward the refrigerating compartment, the flow guide comprising (i) an inlet part configured to receive the cold air blown by the blower fan, (ii) an enlarged part that extends from a lower portion of the inlet part and has a width greater than a width of the inlet part, and (iii) a communication portion defined between the inlet part and the enlarged part;

a manipulator that is rotatably disposed in the enlarged part of the flow guide and comprises a rotating shaft and a manipulation knob connected to the rotating shaft, the manipulation knob being configured to rotate about the rotating shaft and having a front end exposed to a front side of the grille fan assembly;

a gate that is curved and has an inner circumferential surface that is radially spaced apart from an outer circumferential surface of the manipulation knob, the gate facing a first portion of the outer circumferential surface of the manipulation knob and being configured to rotate with the rotating shaft to thereby open and close at least a part of the communication portion of the flow guide; and an angle limiter disposed outside the outer circumferential surface of the manipulation knob and configured to limit a rotation angle of the manipulation knob, wherein the manipulator further comprises a corrugated part having a plurality of ridges and a plurality of furrows that are alternately arranged on a second portion of the outer circumferential surface of the manipulation knob along a rotating direction of the manipulation knob, the plurality of ridges and plurality of furrows being configured to interfere with the angle limiter, wherein the gate comprises a connection part that radially connects the inner circumferential surface of the gate to the outer circumferential surface of the manipulation knob, the connection part having (i) an outer end portion that is connected to the inner circumferential surface of the gate and (ii) an inner end portion that is connected to the outer circumferential surface of the manipulation knob, and wherein the angle limiter comprises (i) a stopper disposed at a position corresponding to the outer circumferential surface of the manipulation knob and (ii) a holding jaw disposed at the outer circumferential surface of the manipulation knob, the stopper being configured to, based on the rotating shaft rotating in a clockwise direction or a counterclockwise direction, contact the connection part or the holding jaw to thereby limit a rotation of the rotating shaft.

2. The refrigerator of claim 1, wherein an inner surface of the enlarged part of the flow guide is curved and connected to the inlet part, and wherein a radius of curvature of the gate is less than a radius of curvature of the inner surface of the enlarged part.

3. The refrigerator of claim 1, wherein a length between ends of the gate is greater than a width of the communication portion of the flow guide.

4. The refrigerator of claim 1, wherein the gate is spaced apart from an inner surface of the flow guide.

5. The refrigerator of claim 1, wherein the gate is spaced apart from an edge of the communication portion of the flow guide.

6. The refrigerator of claim 1, wherein the gate is configured to be located at any one position among a plurality of positions including:

a first position at which the gate is located away from the communication portion such that an entirety of the communication portion is opened;

a second position at which a first end of the gate is located at a center portion of the communication portion;

a third position at which the first end of the gate is located between the center portion of the communication portion and a first end of the communication portion and spaced apart from the first end of the communication portion such that the communication portion is partially opened;

a fourth position at which a center portion of the gate is located at the center portion of the communication portion; and a fifth position at which a second end of the gate is located between the center portion of the communication portion and a second end of the communication portion and spaced apart from the second end of the communication portion such that the communication portion is partially opened.

7. The refrigerator of claim 6, wherein the gate is configured to define an opening ratio of the communication portion with respect to a width of the communication portion based on a position of the gate, and wherein the opening ratio of the communication portion defined based on the gate being located at the third position is less than the opening ratio of the communication portion defined based on the gate being located at the second position.

8. The refrigerator of claim 6, wherein the gate is configured to define an opening ratio of the communication portion with respect to a width of the communication portion based on a position of the gate, and wherein the opening ratio of the communication portion defined based on the gate being located at the fifth position is less than the opening ratio of the communication portion defined based on the gate being located at the third position.

9. The refrigerator of claim 1, wherein the gate defines at least one communication hole configured to communicate with the inlet part and the enlarged part based on at least a portion of the gate being located at the communication portion.

10. The refrigerator of claim 9, wherein the at least one communication hole of the gate is one of a plurality of communication holes that are defined at the gate and have different sizes from one another.

11. The refrigerator of claim 10, wherein the communication holes comprise:

a first communication hole located closer to a first side of the gate than to a second side of the gate, the first communication hole having a first size; and a second communication hole located closer to the second side of the gate than to the first side of the gate, the second communication hole having a second size less than the first size.

12. The refrigerator of claim 1, wherein the flow guide further comprises an outlet part that extends from a lower portion of the enlarged part and is configured to communicate with the refrigerating compartment.

13. The refrigerator of claim 12, wherein a lower end portion of the outlet part is bent or curved forward and protrudes toward the freezer compartment, and wherein the outlet part defines a condensate drain hole at an edge portion of the lower end portion of the outlet part.

14. The refrigerator of claim 1, wherein the inlet part of the flow guide defines an entrance portion located under the blower fan and configured to receive the cold air blown by the blower fan.

15. The refrigerator of claim 1, wherein the inlet part of the flow guide defines a flow path that narrows toward the lower portion of the inlet part and is connected to the enlarged part.

16. The refrigerator of claim 1, wherein the angle limiter is configured to limit the rotation angle of the manipulation knob between 120° and 160° about the rotating shaft.

17. The refrigerator of claim 1, wherein the flow guide further comprises a holding pin that protrudes from the enlarged part and is configured to be located at any one of the plurality of furrows of the corrugated part.

18. The refrigerator of claim 17, wherein each of the plurality of ridges of the corrugated part has a round surface, and wherein the holding pin is configured to be bent based on the holding pin moving along one or more of the plurality of ridges.

19. The refrigerator of claim 1, wherein the holding jaw protrudes from the outer circumferential surface of the manipulation knob and is configured to interfere with the stopper.

20. The refrigerator of claim 19, wherein circumferential ends of the gate are radially spaced apart from the outer circumferential surface of the manipulation knob, and wherein the stopper is disposed between the connection part of the gate and the holding jaw.

* * * * *